United States Patent [19]

Andrews

[11] 4,018,388

[45] Apr. 19, 1977

[54] JET-TYPE AXIAL PULVERIZER

[76] Inventor: Norwood H. Andrews, Box 68, Moorestown, N.J. 08057

[22] Filed: May 13, 1976

[21] Appl. No.: 686,153

[52] U.S. Cl. ..... 241/39

[51] Int. Cl.[2] ..... B02C 19/06

[58] Field of Search ..... 241/5, 39, 40

[56] References Cited

UNITED STATES PATENTS

| | | | |
|---|---|---|---|
| 2,588,945 | 3/1952 | Trost | 241/5 |
| 2,763,437 | 9/1956 | Marchant | 241/29 |
| 3,058,673 | 10/1962 | Firing | 241/39 |

*Primary Examiner*—Granville Y. Custer, Jr.
*Attorney, Agent, or Firm*—Arthur A. Jacobs

[57] ABSTRACT

A jet-type grinding mill having a circular chamber wherein a rotating vortex is formed by gaseous fluid injected into the chamber, the material to be ground being fed into the mill through a feed means at the center of the vortex, there being a central recess at the bottom of the chamber below the feed inlet which has upwardly inclined walls to direct the fed particles upwardly and outwardly into the vortex.

8 Claims, 4 Drawing Figures

FIG. 1
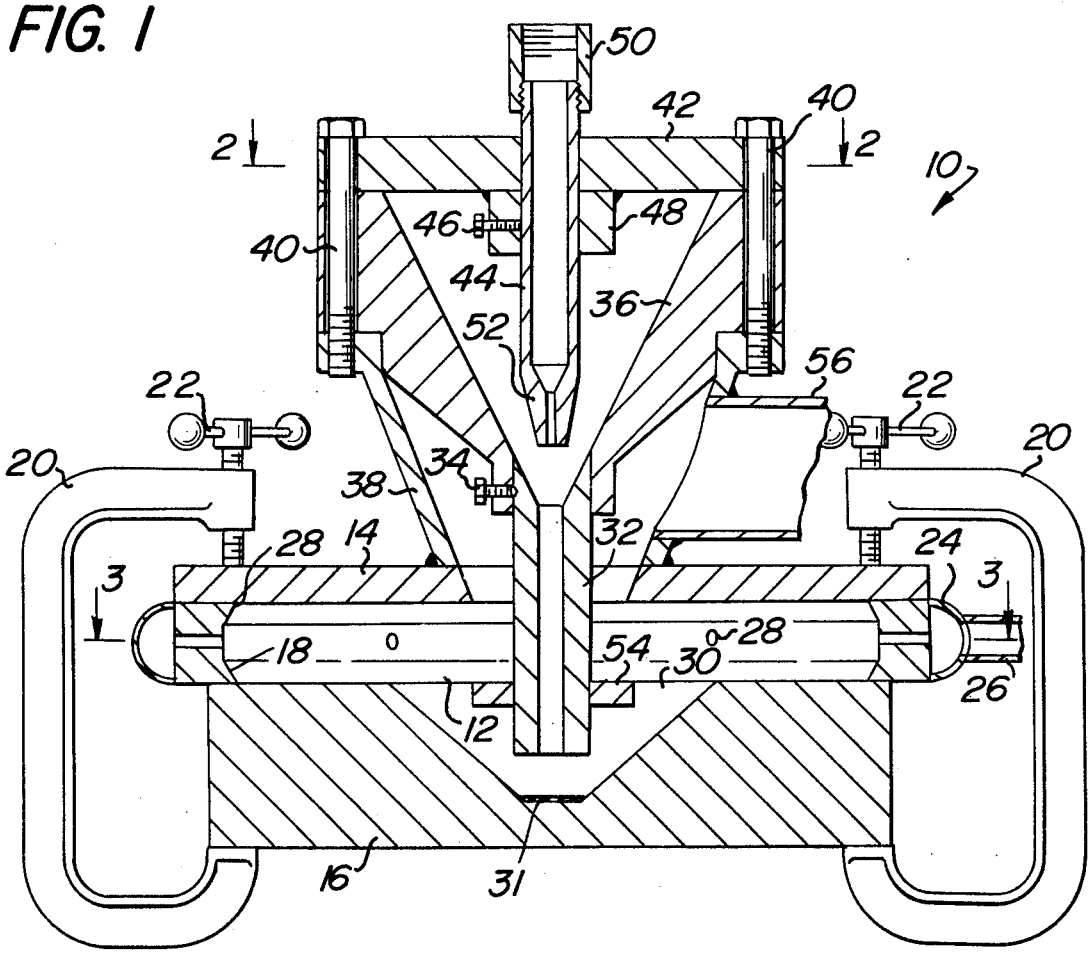
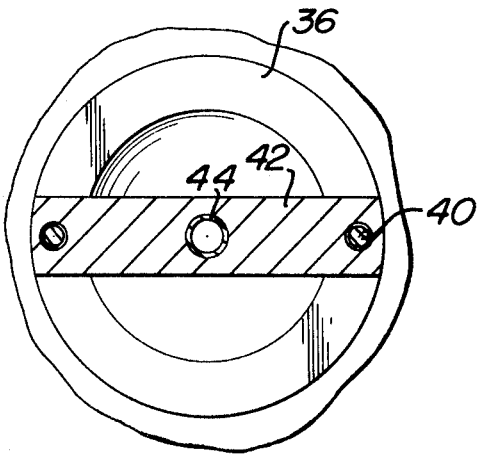
FIG. 2
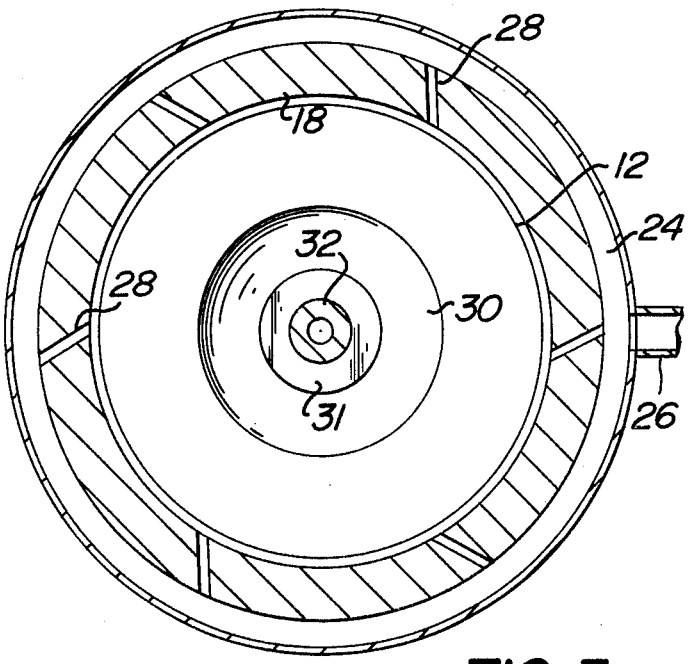
FIG. 3

JET-TYPE AXIAL PULVERIZER

This invention relates to a grinding mill, and it particularly relates to a grinding mill utilizing gaseous fluid as the grinding medium.

So-called "Micronizer"-type circular grinding mills have been used throughout the world for many years. Such mills comprise a circular chamber, the internal height at the periphery being only a fraction of the diameter, and having inlet nozzles arranged around the periphery in such a manner that the gasses issuing therefrom will have both a forward and transverse component of movement. The material to be ground is fed into the chamber in such a manner as to be entrained by the gaseous fluid and whirled around the chamber in a closed continuous circuit. It immediately forms a concentrated, turbulent stream adjacent the inner peripheral wall of the chamber and, as the jets of fluid are introduced with both a forward and transverse component of movement, some of the material in the plane of the jets will be entrained by the various jets and projected through this circulating stream of material with violent and destructive pulverizing impact. As these various material-laden jets expand, they merge and form a wide band of high speed circulating gas and material, frequently described as the tangent circle or classification zone.

It should be understood that the aforementioned wide band of gas and material will not exactly coincide with the tangent circle. As the jets expand to form this band, they will lose some of their initial velocity and tend to bend outwardly from the true tangent circle due to the fact that they are directed transversely to the circulating gas. The extent to which the direction of the jets are influenced by the circulating gas will depend on the size of the jets, the number of jets, the pressure of the gas supplying the jets and the mill load. Mills designed for specific materials may have this tangent circle closer to or further away from the outlet than the periphery. As the gas leaves the outer portion of this classification zone toward the periphery of the mill, it slows down due to (a) loss of the driving energy of the jets (b) the frictional contact with the peripheral wall, and (c) the work required to entrain the material. Inwardly of this zone, the angular velocity increases but the linear velocity decreases.

Regardless of the radial location of the tangent circle, it represents the zone of highest velocity in the mill. It is from this zone that particles which are too large for a product are thrown outwardly by centrifugal force to merge with the particles circulating adjacent to the inner periphery of the mill, to again be picked up by the jet streams and again be impacted as aforementioned. Particles that are satisfactory as a product, because of their increased surface area in respect to their weight, will have their centrifugal force overcome by the inward entraining force of the gas leaving the classification zone and pass out of the central outlet with this gas, as a product.

Usually, except for special grinding problems, the tangent circle, or classification zone, is about halfway between the peripheral wall and the outlet. Better grinding occurs when the tangent circle is nearer the outlet, but experience has proven that large particles projected by one or more jets, and impacting other large particles projected by other jets, frequently glance off each other or are shattered, and individual particles are directed toward the outlet. The radial distance between the classification zone and the final outlet may be considered a safety distance factor, allowing large particles, which are undesirable as a product, to again gain centrifugal momentum which would permit them to return to the classification zone and then to the grinding zone. Any axial restriction in this inner radial distance reduces the change for larger particles to return to the classification zone and then to the grinding zone and, in fact, can sweep to the outlet those intermediate size particles that are undesirable as a product. It is to be understood that any axial restriction at or near the outlet speeds up the radial inward flow of gas well outward of the restriction. In other words, "upstream, it converges to the throat."

It will consequently be readily understood that, with parallel top and bottom walls, the cubical content of the chamber decreases rapidly toward the outlet and, consequently, the radial inward velocity and the entraining force of the gas increases proportionally without a corresponding increase in the centrifugal force.

Although there are many "Micronizers" with parallel top and bottom walls, such mills are generally adapted to produce only a fairly uniform intermediate size material. It is also necessary to have a complete understanding of the physical characteristics of the material, such as its specific gravity, and a complete understanding of the volume and pressure of the gas in relation to the axial height of the mill.

In most earlier versions of the "Micronizer"-type mills, the material was introduced at a single point adjacent the periphery and in such a direction that the injecting fluid gave the feed material an initial velocity in the same direction as the circulating gases in the mill.

Although the aforesaid initial velocity in the direction of rotation was helpful, it still did not distribute the feed material uniformally around the periphery, and consequently a method of feeding outside the classification zone through a multiplicity of inlets was substituted. This method was especially preferred when grinding various types of free-flowing materials. However, it was not as successful when grinding certain damp, viscous, or precipitated materials, as these frequently tend to clog up the distributor manifold. Furthermore, even with free-flowing materials, uniform distribution of the feed material was not assured because the size and number of feed inlets, the bulk characteristics of the feed material, and the volume of gas used to introduce the feed material into the distributor manifold are all factors that are difficult to accurately correlate in order to insure uniform feed from each feed inlet.

Attempts to insure a desirable uniformity have included such steps as having the inlet holes progressively increase in size following the injector means, as well as providing a continuous slit from the manifold to the inside of the mill. However, neither of these alternate means showed improvement over the use of a multiplicity of inlets, although it was early learned that a rule of thumb was not to have many more inlets than the number of nozzles in the mill and to restrict the total area so as to insure a greater pressure in the manifold than in the mill. Nevertheless, although this insures that material from the mill will not enter the manifold, it does not insure that all inlets will carry the same quantity of material into the mill. In addition, because of wall friction in the manifold and abrupt change of direction, even when the holes are inclined from the manifold to the inside of the mill, the feed material will not join the circulating load with as great a velocity as when a single inlet is used. The result is a sacrifice of the tangential velocity in favor of a more uniform distribution of the feed.

Many attempts have been made to eliminate this energy requirement, such as by screw-feeding the material into the mill. Since the circulating gases have no flywheel effect, it is readily understood that there is a localized shock to the conformity of flow as the circulating gases try to accelerate the feed from a static condition to the velocity of the circulating load in the mill. Therefore, screw-feeding close to the outlet results in a considerable amount of the material being radially entrained to the outlet before it can develop sufficient centrifugal force to be rejected outwardly to the tangent circle which is the classification zone.

One object of the present invention is to overcome the above and other problems by providing a mill in which the material may be fed through a single inlet with a minimum of energy and while preserving uniformity of particle distribution in the mill.

A second object of the present invention is to provide means for all the feed material, including the finer fractions thereof, to enter the classification zone before the strong radially inward flow of the gases, which is the strongest in the plane of the jets, carries undesirable sizes of the material out of the mill as a product.

A third object of the present invention is to utilize the spiral action of the gas in the conical section of the mill to join with the injector gas and to assist in the uniform distribution of the feed material into the classification zone.

A fourth object of the present invention is to utilize the intense circular velocity of the gases in the classification zone to accelerate the feed material to a velocity in excess of the velocity of the circulating load in order not to abstract energy from the circulating stream adjacent the inner periphery of the mill.

A fifth object of the present invention is to uniformly distribute damp, viscous or precipitated material directly to the entire circumference of the classification zone.

Other objects and many of the attendant advantages of this invention will be readily appreciated as the same become better understood by reference to the following description, when read in conjunction with the accompanying drawings, wherein:

FIG. 1 is a sectional view of a mill embodying the present invention.

FIG. 2 is a sectional view taken on line 2—2 of FIG. 1.

FIG. 3 is a sectional view taken on line 3—3 of FIG. 1.

Figure 4:
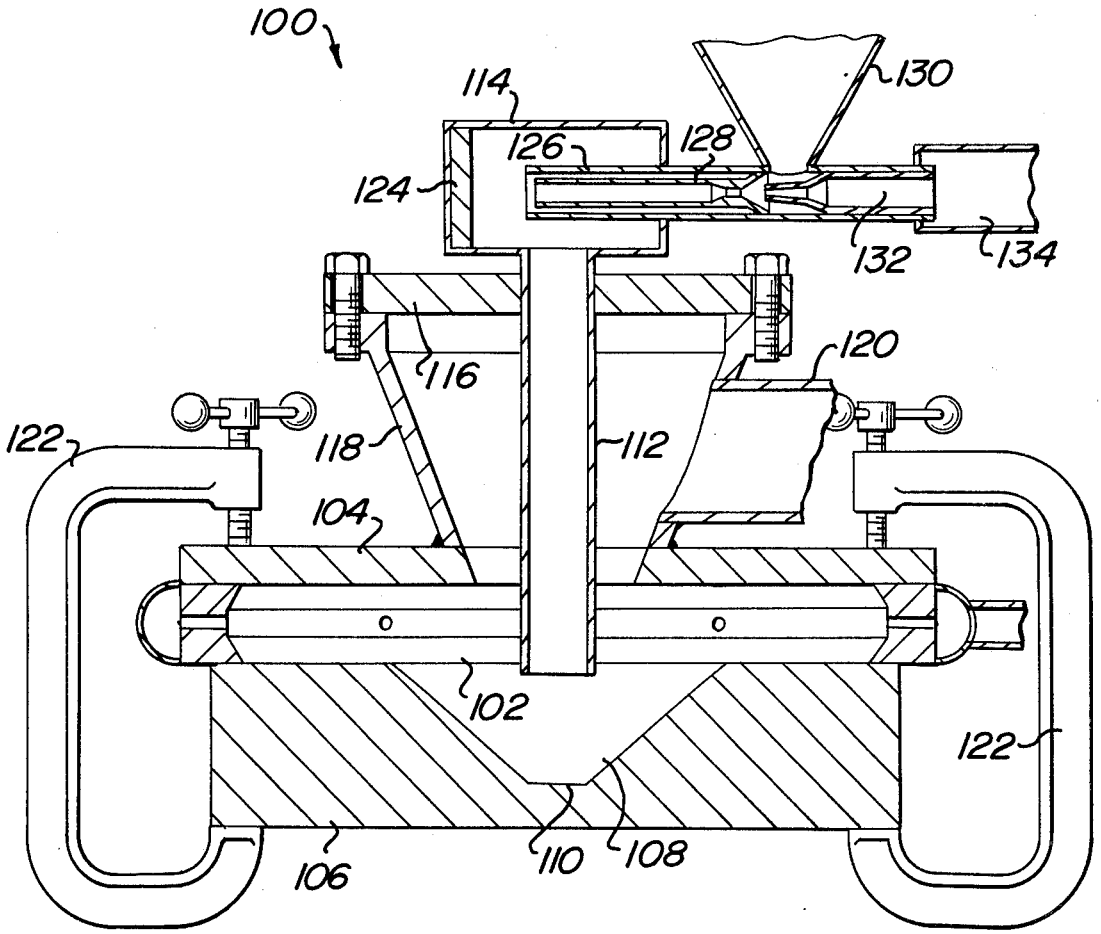
FIG. 4 is a sectional view of a modified embodiment of the invention.

In accordance with the present invention, the feed material is axially introduced into the apex of a hollow inverted frustum, centrally located in relation to the periphery of the mill, be gaseous fluid used as an injector means. The upper, larger diameter of this recess is such that it generally coincides with the high-speed classification zone. In this manner, the feed material is dispersed outwardly and upwardly underneath this high-speed classification zone by the injector fluid and entrained air.

During the operation, the whirling vortex in the mill extends downwardly into this zone and, mixing with the upward and outward flow of injector fluid, aids in a more uniform distribution of the feed material into the classification zone.

Although there may be some variations in the diameter and depth of this zone, even in mills of the same size, an upper diameter generally coinciding with the tangent zone and having a depth one and one-half or twice the peripheral height of the mill proper has been found to present an angle effective in obtaining the above-mentioned results.

Merely for exemplification, and without attempting to limit the actual proportions and relationships between the various parts, one type of mill embodying this invention would have a chamber with an inner diameter of 6 inches—there being six nozzles of 3/32 of an inch diameter tangent to a 3-inch circle. The peripheral height of the wall of the chamber is ⅝ of an inch, the larger diameter of the cup is 3 inches and its depth is 1¼ inches. The apex of the cup is flat and is 1 inch in diameter.

Another mill embodying this invention would have 20 inches inside diameter of the peripheral wall, and there would be eight nozzles of 7/32 of an inch, tangent to a 12-inch circle. The peripheral height of the wall would be 1⅜ inches, the largest diameter of the cup would be 13½ inches, and its depth would be 2½ inches. The apex of the cup would be flat and 2½ inches in diameter. In each case, the flat apex is hard-surfaced with tungsten carbide.

Referring more particularly to the drawings wherein similar reference characters refer to similar parts, there is shown a mill, generally designated 10, comprising a circular grinding chamber 12. The chamber 12 is defined by an upper plate 14, a lower plate 16, and an annular concave wall 18, all held together by clamps 20 and bolts 22. Although this type of construction is preferred because it permits easy disassembly for cleaning or other purposes, the chamber may be made of unitary construction or of any other feasible construction desired.

Surrounding the annular wall 18, is an annular fluid chamber 24 having an inlet 26 connected to a source of gaseous fluid under pressure (not shown). The wall 18 is provided with a plurality of spaced inlet nozzles 28 leading from the fluid chamber 24 into the grinding chamber 12 and tangent to an imaginary circle within the grinding chamber.

Within the central portion of the plate 16, defining the bottom of the grinding chamber, is provided a generally cup-shaped recess 30 having a flat bottom wall. A hardened liner of tungsten carbide or the like is provided at 31 at the bottom of the recess 30. Depending into the recess 30, is a tubular duct 32 releasably connected by a set screw 34 to a funnel 36 supported by the upper end of a frusto-conical housing 38 mounted on plate 14. A pair of bolts 40 connect the funnel to the brackets and also connect a bridge member 42 to the top of the funnel.

The bridge 42 is provided with a central aperture through which extends a conduit 44. The conduit 44 is fixed to the bridge 42 by a set screw 46 extending through a block 48 fixed to the underside of the bridge 42. The upper end of the conduit 44, above the bridge 42, is provided with a threaded collar 50 to permit coupling to a supply pipe or the like, while the lower end of the conduit 44 is constructed to form a nozzle 52. The nozzle 52 is positioned above the lower end of the funnel 36 and is in spaced but aligned longitudinal relationship with the duct 32.

An exhaust duct 56 is connected to the side of the housing 38 and is in communication with the interior of the housing and, through it, with the interior of chamber 12.

In operation, the gaseous fluid is propelled into the chamber 12 through the nozzles 28 and the material to be treated is entrained by the flow of gas issuing through nozzle 52 from conduit 44 into the expanded upper end of duct 32. This expanded upper end of duct 32 preferably forms a tapered continuation of the lower end of feed funnel 36. The relationship of nozzle 52 to the tube 32 is such that a considerable suction occurs in the tapered entrance to this tube and all the feed material follows the air sucked in by this injector means and is projected through the accelerating tube, which is constituted by the passage through the duct 32, into impact with the central or lower part of recess 30. This provides an effective jet and anvil grinding means and, consequently, it is desirable to either hard surface this impact plate, as shown at 31, or provide removable liners or the like.

After impact, the gas, with its entrained air and material, is dispersed outwardly and upwardly while the vortex in chamber 12 extends down into the recess 3 and, mixing with this gas and material, assists in the uniform distribution of the feed material into the classification zone.

As previously mentioned, the classification zone is being continuously supplied with particles in different stages of reduction as a result of the action of the jets 28 on the circulating material adjacent the periphery. From this classification zone the more finely ground particles resulting from the pulverization process converge radially to the central outlet and through it to housing 38, and are then discharged through exhaust port 56 to collection means (not shown,) while the larger particles are centrifugally returned to the outer periphery, or that outer portion generally referred to as the grinding zone.

In order to more fully understand the present invention, it should be pointed out that axial feeding of "Micronizer"-type mills is of itself not new. Such axial feeding is illustrated and described in applicant's U.S. Pat. No. 2,032,827. This mill was tested on coarse limestone and operated as described, but when preground material, as is universally fed to "Micronizer"-type mills, was introduced, some of the finer fractions, which are undesirable as a product, were carried out of the mill by the upward tornadic force of the gas above the plane of the jets. Attempts to drive these finer fractions radially outward into the classification zone, before the vertical tornadic force carried them out of the mill, by increasing the force of the injector fluid, proved unsuccessful, and consequently, that mill was not commercially practical.

Other patents, such as U.S. Pat. No. 2,763,437, and U.S. Pat. No. 3,058,673, also show axial feeding means, but due to the use of baffles, plates and other restricting means for the gases adjacent the outlet, the essential radially outward flow of the feed material was interfered with.

In summary, none of these prior patents show or even suggest any intent of introducing the feed material axially of the exhaust into the apex of a hollow frustrum depended from the lower plate so that material driven outwardly and upwardly will enter the classification zone from below.

It is, of course, to be understood that when reference is made to "outwardly and upwardly" or to "below," this refers to a mill in which the jets are in a horizontal plane. As gravity has no effect on the operation of these mills, it might be better stated that the feed material is directed through the plane of the jets into a recess as described.

It is to be pointed out that although it is generally preferable to have the discharge end of injector tube 32 extend into cup 30, it is not necessary when grinding coarse heavy material and using a large pressure nozzle to inject the feed.

It is also to be understood that disc 54 is not necessary when grinding free flowing material, but has been found desirable when grinding some damp fibrous materials. When it is used, it is important that the upper surface does not restrict the axial height of the chamber and a preferred position is when the upper surface of disc 54 is below the horizontal surface of bottom plate 16. Furthermore, its diameter should be no greater than the mill outlet.

In FIG. 4, there is shown a modified form of the invention which is generally designated 100. In this form of the invention, the chamber 102 is similar to the chamber 12 of FIG. 1, including the upper plate 104 and lower plate 106. The lower plate 106 is similarly provided with a generally cup-shaped recess 108 having a flat lower end 110.

However, the feed tube 112 terminates, at its lower end, substantially in the plane of the upper surface of the lower plate 106, while, at its upper end, it is provided with a housing 114, forming an impact chamber.

The tube 112 is held in position by a bridge member 116 connected to a frusto-conical housing 118 similar to housing 38 in FIG. 1. The housing 118 is provided with an exhaust duct 120 similar to exhaust duct 56. Clamps 122 and their associated parts are similar in structure and function to the corresponding parts in FIG. 1.

The impact chamber 114 is provided with a hardened impact block or anvil 124 at one side, while, in spaced opposed relation to the anvil 124, is a feed duct 126 having a Venturi passage 128. The duct 126 extends laterally from the lower or outlet end of a funnel 130 and is in alignment with an injector nozzle 132 connected to a supply of gaseous fluid (not shown) through a pipe 134.

In operation, the feed material is inserted through funnel 130 and is entrained by the pressure fluid from nozzle 132, which injects the material into the Venturi passage 128, where it is accelerated and propelled against the anvil 124. The crushed material rebounds from anvil 114 and is hurled through the tube 112. The process then follows that described for the apparatus shown in FIGS. 1 to 3, whereby the feed material passes up from the recess 108 into the chamber 102.

The primary difference between the form of the invention shown in FIG. 1 and that shown in FIG. 4 is that the jet and anvil effect is provided prior to passage of the feed material into the recess 108, whereby wear of the surfaces of the recess is reduced.

The invention claimed is:

1. A grinding and classifying mill comprising a generally circular chamber defined by an upper wall, a lower wall, and a peripheral wall, said peripheral wall having a plurality of gaseous fluid nozzles arranged to propel gaseous fluid in both a forward and a transverse direction relative to the axis of said chamber to form a fluid vortex in said chamber, said nozzles being connected to a source of gaseous fluid under pressure, a generally conical recess in the central portion of said lower wall, a feed inlet means in the axial plane of said chamber, said feed inlet means having its outlet end aligned with the apex end of said recess, said feed inlet means being coaxial with an exhaust means leading from the central area of said chamber.

2. The mill of claim 1 wherein said feed inlet means extends into said recess in spaced relationship to the apex end of said recess.

3. The mill of claim 1 wherein the outlet end of said feed inlet means is in the plane of said upper wall of the chamber.

4. The mill of claim 1 wherein said apex end of the recess is provided with a hardened surface.

5. The mill of claim 1 wherein said feed inlet means is provided with an inlet end leading into an impact chamber, said impact chamber having an anvil surface at one side thereof and a gaseous fluid-actuated material feed means in spaced opposition to said anvil surface, said fluid-actuated material feed means being connected to both a source of material and a source of fluid under pressure.

6. The mill of claim 1 wherein said feed inlet means is provided with a radially extending disc substantially in the plane of the upper surface of said lower wall, said disc having a diameter substantially smaller than the diameter of said recess in the plane thereof.

7. The mill of claim 1 wherein said feed inlet means comprises a funnel having a feed nozzle internally thereof and coaxial therewith, said feed nozzle being spaced from the outlet end of said funnel, and a duct dependent from said outlet end of said funnel and extending through said chamber and into said recess, said funnel and duct forming a Venturi passage.

8. The mill of claim 1 wherein said upper wall and lower wall of said chamber are generally circular plates and said peripheral walls is an annular ring spacing said plates from each other, said plates and ring being releasably connected to form said chamber.

* * * * *